US006012310A

United States Patent [19]

Hsiao

[11] Patent Number: 6,012,310

[45] Date of Patent: Jan. 11, 2000

[54] MOTORIZED LOCK ASSEMBLY

[76] Inventor: Yao-Shiung Hsiao, No. 1-3, Ting Liao, Sanho Tsun, Shuishang Hsiang, Chiayi Hsien, Taiwan

[21] Appl. No.: 09/188,259

[22] Filed: Nov. 10, 1998

[30] Foreign Application Priority Data

Jul. 30, 1998 [TW] Taiwan ..... 87212388

[51] Int. Cl.[7] ..... E05B 47/00

[52] U.S. Cl. ..... 70/278.2; 70/278.7; 70/279.1; 70/280; 70/379 R; 70/422; 292/144

[58] Field of Search ..... 70/222, 277, 278.1, 70/278.2, 278.3, 278.6, 278.7, 279.1, 280–282, 283.1, 379 R, 379 A, 380, 422; 292/144

[56] References Cited

U.S. PATENT DOCUMENTS

| | | | |
|---|---|---|---|
| 559,308 | 4/1896 | Palmer | 70/277 |
| 3,767,240 | 10/1973 | Belanger | 292/144 |
| 4,438,962 | 3/1984 | Soloviff et al. | 292/144 |
| 4,956,984 | 9/1990 | Chi-Cheng | 70/277 |
| 4,967,305 | 10/1990 | Murrer et al. | 70/278.1 X |
| 4,995,248 | 2/1991 | Liu | 70/277 X |
| 5,010,752 | 4/1991 | Lin | 70/277 |
| 5,544,507 | 8/1996 | Lin | 70/277 X |
| 5,857,365 | 1/1999 | Armstrong | 292/144 X |
| 5,896,769 | 4/1999 | Elperu et al. | 70/279 |

*Primary Examiner*—Lloyd A. Gall
*Attorney, Agent, or Firm*—Bacon & Thomas, PLLC

[57] ABSTRACT

A motorized lock assembly includes a lock bolt mounted in a door and having a rotary core containing a first slot, an inside assembly having a casing attached to the inside of the door, and a transmission mechanism having a rectangular block rotated by a drive device, and an extension post containing a second slot aligning with the first slot, and an outside assembly attached to the outside of the door and having an elongate rotor in turn extending through the first slot and the second slot such that the rotary core rotates in conjunction with the extension post, whereby the rectangular block can be rotated so as to rotate the extension post and the rotary core, thereby extending a dead bolt outward from the lock bolt.

10 Claims, 7 Drawing Sheets

MOTORIZED LOCK ASSEMBLY

BACKGROUND OF THE INVENTION

1. Field of the Invention

The present invention relates to a motorized lock assembly.

2. Description of the Related Art

A conventional motorized lock adapted to be fitted onto a door is used to open the door by pressing push buttons mounted on a panel of the motorized lock, thereby allowing a user to open the lock without the necessity of carrying the lock keys at all times. However, the motorized lock stops operating when the power is shut off and when the batteries in the lock are dead, the door cannot be opened, thereby causing inconvenience to the user. The present invention serves to mitigate and/or obviate this disadvantage of the conventional motorized lock.

BRIEF SUMMARY OF THE INVENTION

In accordance with one aspect of the present invention, there is provided a motorized lock assembly for a door having an inside and an outside. The motorized lock assembly comprises a lock bolt fixedly mounted in the door and including a rotary core rotatably mounted therein and containing a first slot therein. An inside lock comprises a casing attached to the inside of the door, a transmission mechanism including a rectangular block rotatably mounted in the casing, a retaining cylinder integrally extending from the rectangular block, and an extension post integrally extending from the retaining cylinder and containing a second slot aligning with the first slot, and drive means for rotating the rectangular block. An outside lock is attached to the outside of the door and includes an elongate rotor rotatably mounted thereon and in turn extending through the first slot and the second slot such that the rotary core rotates in conjunction with the extension post.

Further benefits and advantages of the present invention will become apparent after a careful reading of the detailed description with appropriate reference to the accompanying drawings.

DETAILED DESCRIPTION OF THE INVENTION

Figure 1:
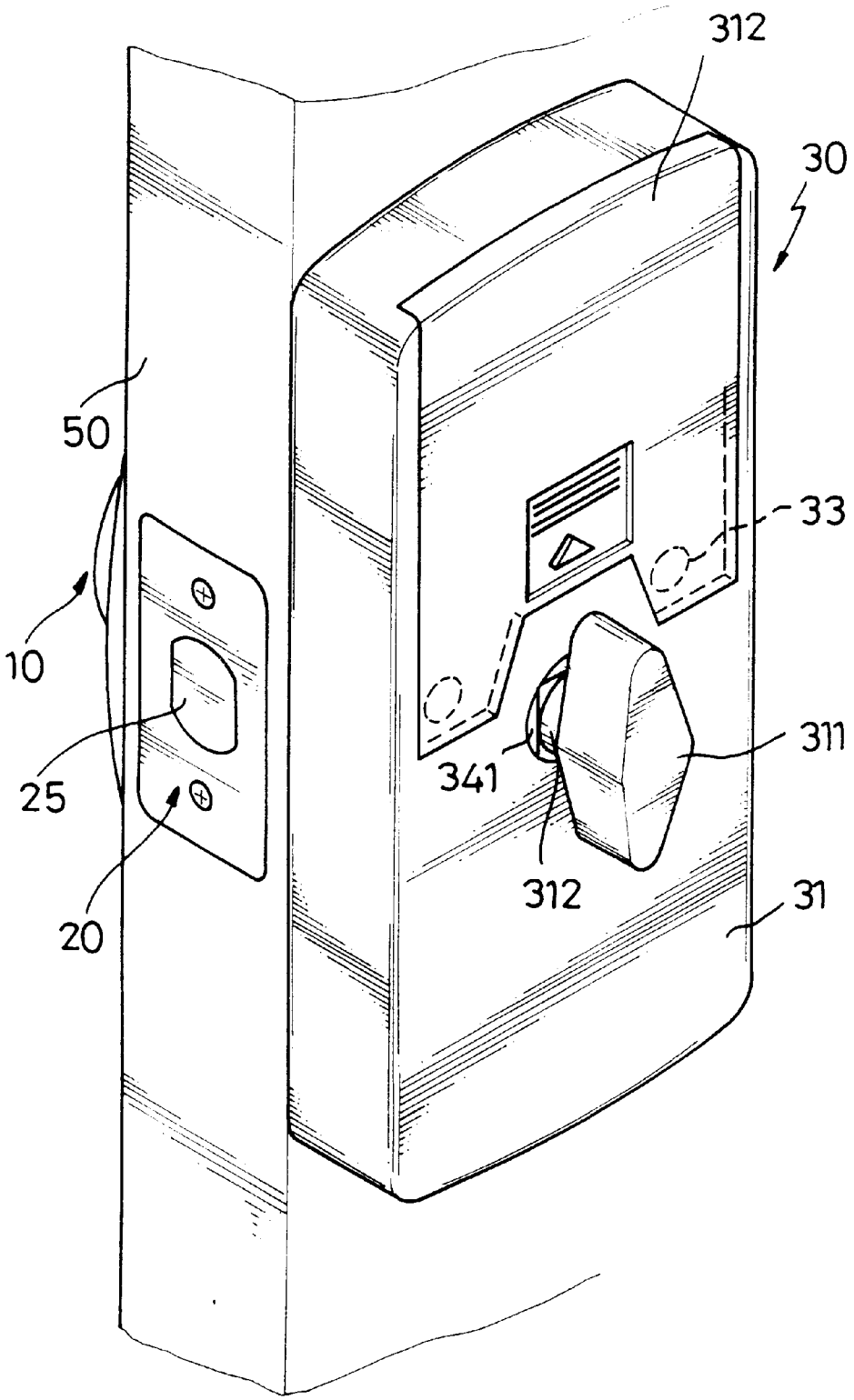
FIG. 1 is a perspective view of a motorized lock assembly in accordance with the present invention.
Figure 2:
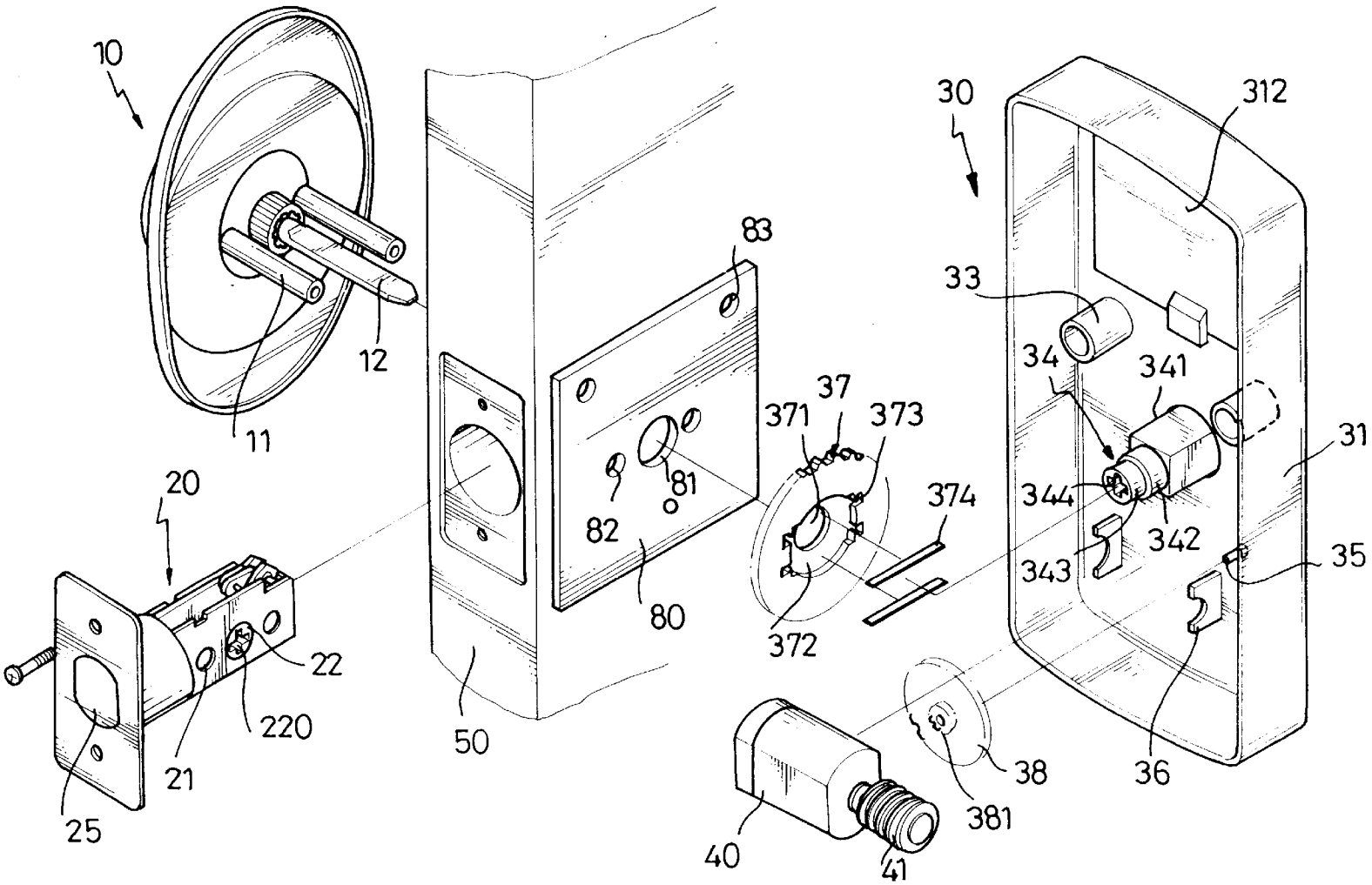
FIG. 2 is an exploded view of the motorized lock assembly as shown in FIG. 1.
Figure 3:
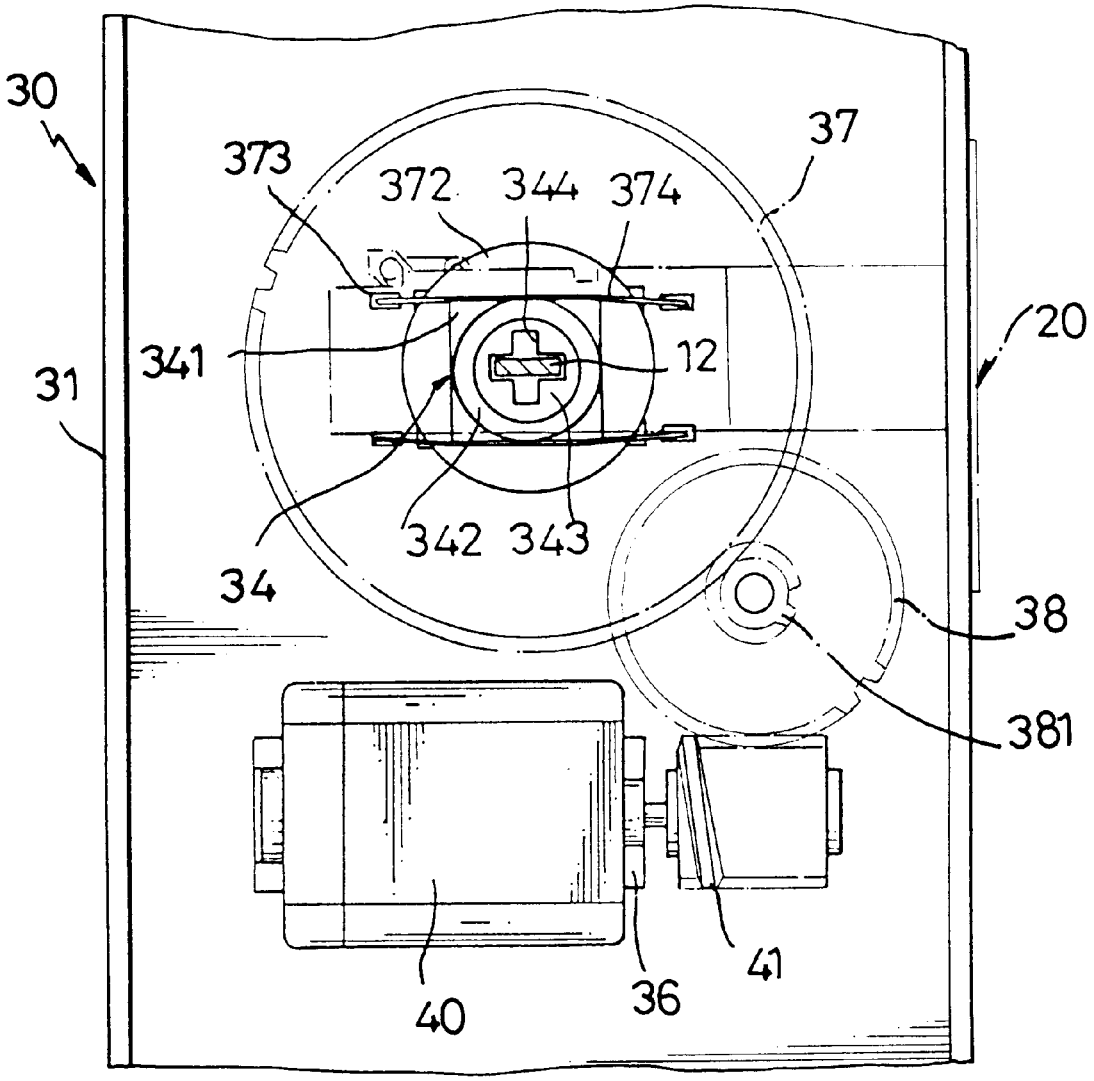
FIG. 3 is a side plan cross-sectional assembly view of the motorized lock assembly as shown in FIG. 2.

Referring to the drawings and initially to FIGS. 1–3, a motorized lock assembly in accordance with the present invention can be utilized with a door (50) having an inside and an outside.

The motorized lock assembly comprises a lock bolt (20) fixedly mounted in the door (50) and including a rotary core (22) rotatably mounted therein and containing a cross-shaped first slot (220) therein.

An inside assembly (30) comprises a casing (31) attached to the inside of the door (50), a transmission mechanism (34) including a rectangular block (341) rotatably mounted in the casing (31), a retaining cylinder (342) integrally extending from the rectangular block (341), and an extension post (343) integrally extending from the retaining cylinder (342) and containing a cross-shaped second slot (344) aligning with the first slot (220), and a drive device used for rotating the rectangular block (341).

An outside assembly (10) is attached to the outside of the door (50) and includes an elongated rotor (12) rotatably mounted thereon and in turn extending through the first slot (220) and the second slot (344) such that the rotary core (22) rotates in conijunction with the extension post (343).

The drive device comprises a driven gear (37) mounted on the rectangular block (341) for rotating it, a support shaft (35) fixedly mounted in the casing (31), a gear (38) rotatably supported on the support shaft (35), a drive gear (381) integrally formed on the gear (38) and meshing with the driven gear (37), a worm gear (41) rotatably mounted in the casino (31) and meshing with the gear (38), and a motor (40) mounted in the casing (31) and retained in two brackets (36) for rotating the worm gear (41). A plurality of batteries (not shown) are received in the casing (31) for supplying power to the motor (40), and a cover (312) is detachably attached to the casing (31) whereby a user can replace the batteries after removing, the cover (312).

The driven gear (37) transversely contains a receiving recess (372) for receiving the rectangular block (341), and the drive device further comprises two spaced elastic drive strips (374) each fixedly mounted in the receiving recess (372) and each pressing the rectangular block (341) such that the rectangular block (341) rotates in conjunction with the driven gear (37). The receiving recess (372) contains two pairs of opposite locking openings (373) in the periphery thereof for locking each of the two elastic drive strips (374) therein. The driven gear (37) transversely contains a center hole (371) open to the receiving recess (372) for receiving the retaining cylinder (342) therein.

The inside assembly (30) further comprises a knob (311) rotatably mounted on the casing (31) and including a spindle (312) fixedly mounted in the rectangular block (341) whereby the rectangular block (341) rotates in conjunction with the knob (311).

In assembly, a plate (80) is fixed to the inside of the door (50) and contains a center hole (81) for receiving the extension post (343), two holes (82) each located adjacent to the center hole (81), and two bores (83) each located at corners of the fixed plate (80). The outside assembly (10) further includes two threaded rods (11) each in turn extending through the door (50), one of two holes (21) contained in the lock bolt (20), and through the respective hole (82), and two locking screws (not shown) each screwed into the corresponding threaded rods (11), thereby attaching the outside lock (10) to the door (50). The inside assembly (30) further includes two positioning tubes (33) each formed in the casing (31), and two locking screws (not shown) each in turn extending through one of the two corresponding positioning tubes (33) and one of the two corresponding bores (83), and each screwed into the door (50), thereby attaching the inside assembly (30) to the door (50).

Figure 4:
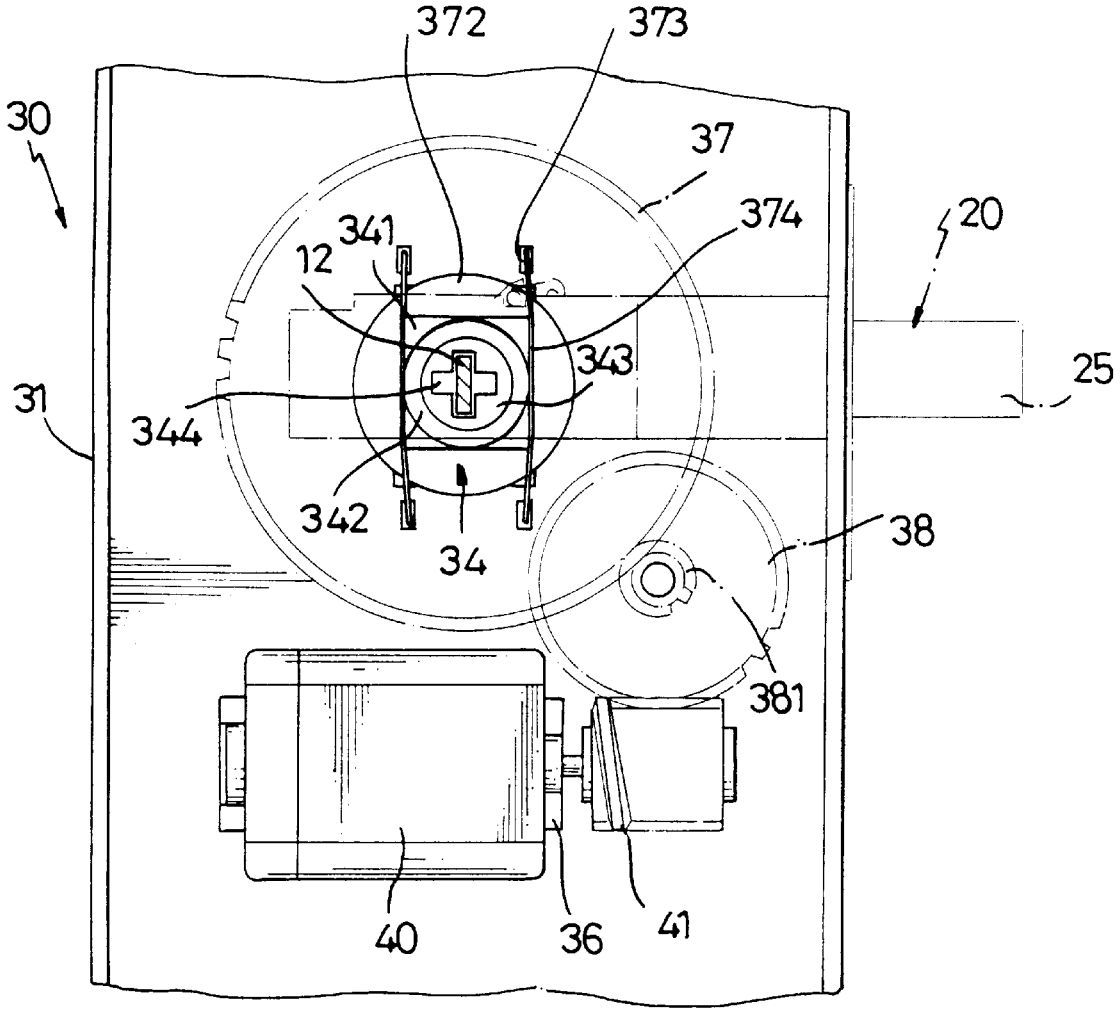
FIG. 4 is a operational view of the motorized lock assembly as shown in FIG. 3.

In operation, referring now to FIGS. 3 and 4 with reference to FIGS. 1 and 2, the worm gear (41) can be rotated by the motor (40) to rotate the gear (38) which rotates the drive gear (381) which in turn rotates the driven gear (37) which rotates the rectangular block (341) by means of the two elastic drive strips (374) so as to rotate the extension post (343) which in turn rotates the elongate rotor (12) from the position as shown in FIG. 3 to the position as shown in FIG. 4 such that the rotary core (22) can be rotated by the elongate rotor (12). thereby moving the dead bolt (25) of the lock bolt (20) to extend outward from the door (50) as shown in FIG. 4. By such an arrangement, the movement of the dead bolt (25) can be controlled by the electric drive device.

When the motor (40) stops operating due to dead batteries, the knob (311) can be rotated manually to rotate the spindle (312) thereof which in turn rotates the rectangular block (341) by means of overcoming the pressing force exerted on the rectangular block (341) by the two elastic strips (374), so as to rotate the extension post (343) which in turn rotates the elongate rotor (12) such that the rotary core (22) can be rotated by the elongate rotor (12), thereby moving the dead bolt (25) of the lock bolt (20) to extend outward from the door (50) as shown in FIG. 4. Alternatively, a key can be inserted into a keyhole (not shown) in the outside assembly (10) so as to rotate the elongate rotor (12) such that the rotary core (22) can be rotated by the elongate rotor (12), thereby moving the dead bolt (25) of the lock bolt (20) to extend outward from the door (50) as shown in FIG. 4. By such an arrangement, the movement of the dead bolt (25) can be operated manually.

Figure 5:
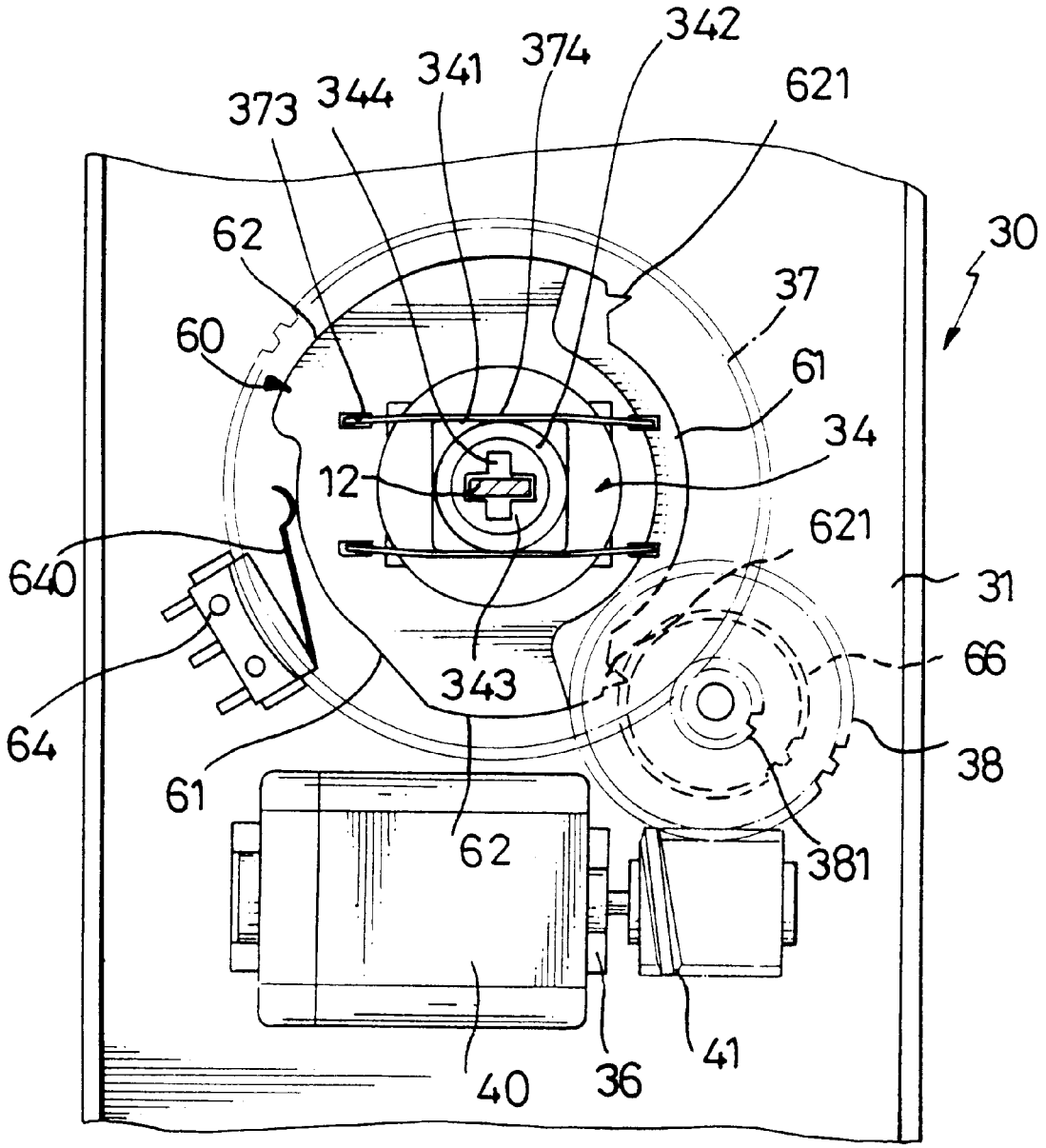
FIG. 5 is a side plan cross-sectional assembly view of the motorized lock assembly as shown in FIG. 2.
Figure 6:
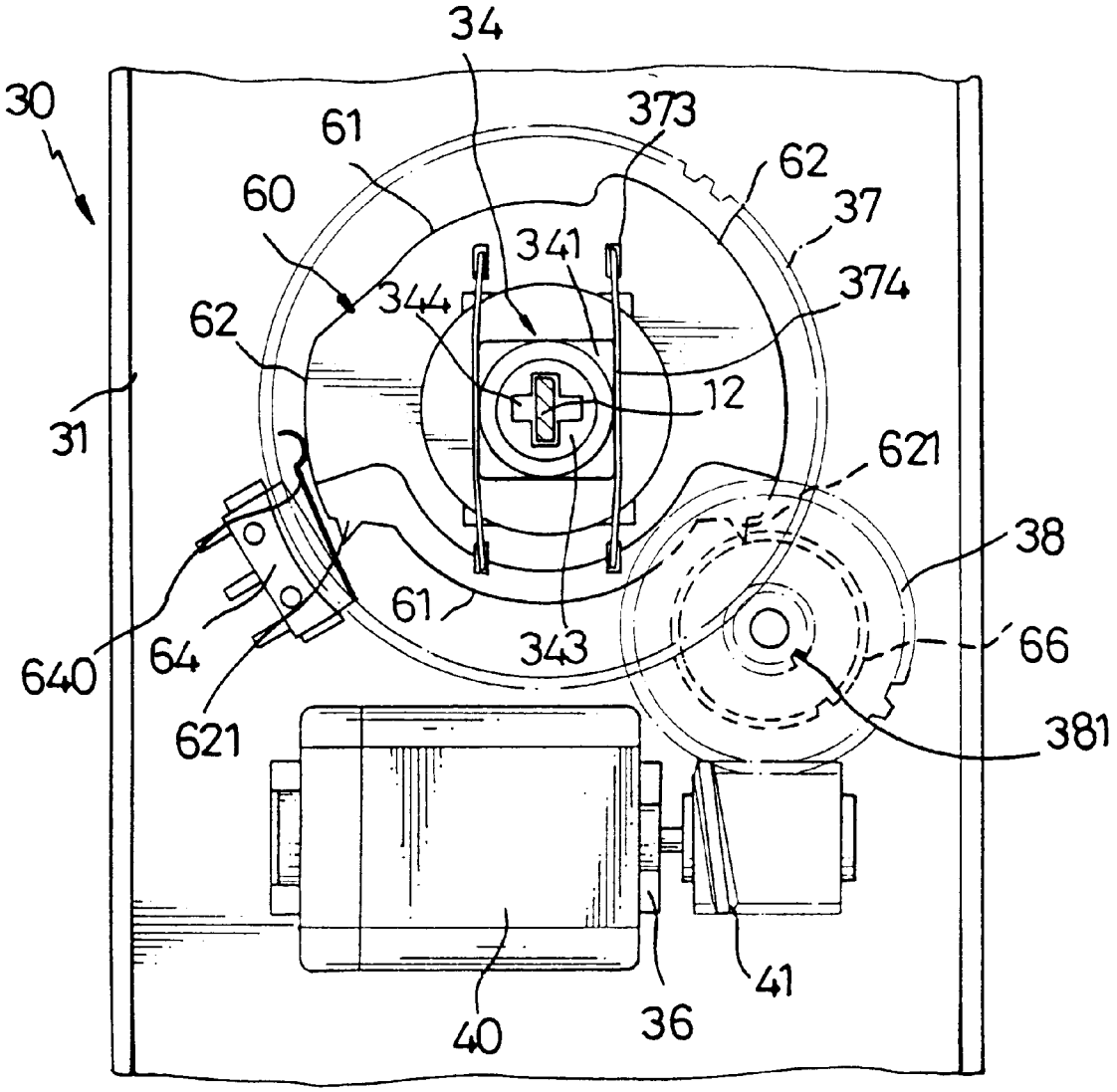
FIG. 6 is an operational view of the motorized lock assembly as shown in FIG. 5.

Referring now to FIGS. 5 and 6 with reference to FIGS. 1–4, the motorized lock assembly further comprises a first cam disk (60) fixedly mounted on the driven gear (37) to rotate therewith, two opposite arcuate lugs (62) each formed on the periphery of the first cam disk (60) and each including a locking tooth (621), two opposite concave openings (61) each contained between the two arcuate lugs (62), a microswitch (64) mounted in the casing (31) and including a control lever (640) pivotally mounted thereon and abutting the periphery of the first cam disk (60), and a second cam disk (66) mounted on the gear (38) for stopping the locking tooth (621) of one of the two arcuate lugs (62).

In operation, when the elongate rotor (12) is rotated by means of rotation of the driven gear (37) from the position as shown in FIG. 5 (similar to FIG. 3) to the position as shown in FIG. 6 (similar to FIG. 4), the first cam disk (60) is rotated with the driven gear (37) such that the locking tooth (621) of one of the two arcuate lugs (62) is moved by the first cam disk (60) to abut the periphery of the second cam disk (66), thereby stopping the rotation of the driven gear (37). It is to be noted that, one of the two arcuate lugs (62) will press the control lever (640) of the microswitch (64) before the locking tooth (621) reaches its final position as shown in FIG. 6 whereby the microswitch (64) can be used to stop the operation of the motor (40) while the driven gear (37) together with the first cam disk (60) can still be rotated continuously by means of the residual inertial torque of the motor (40).

Figure 7:
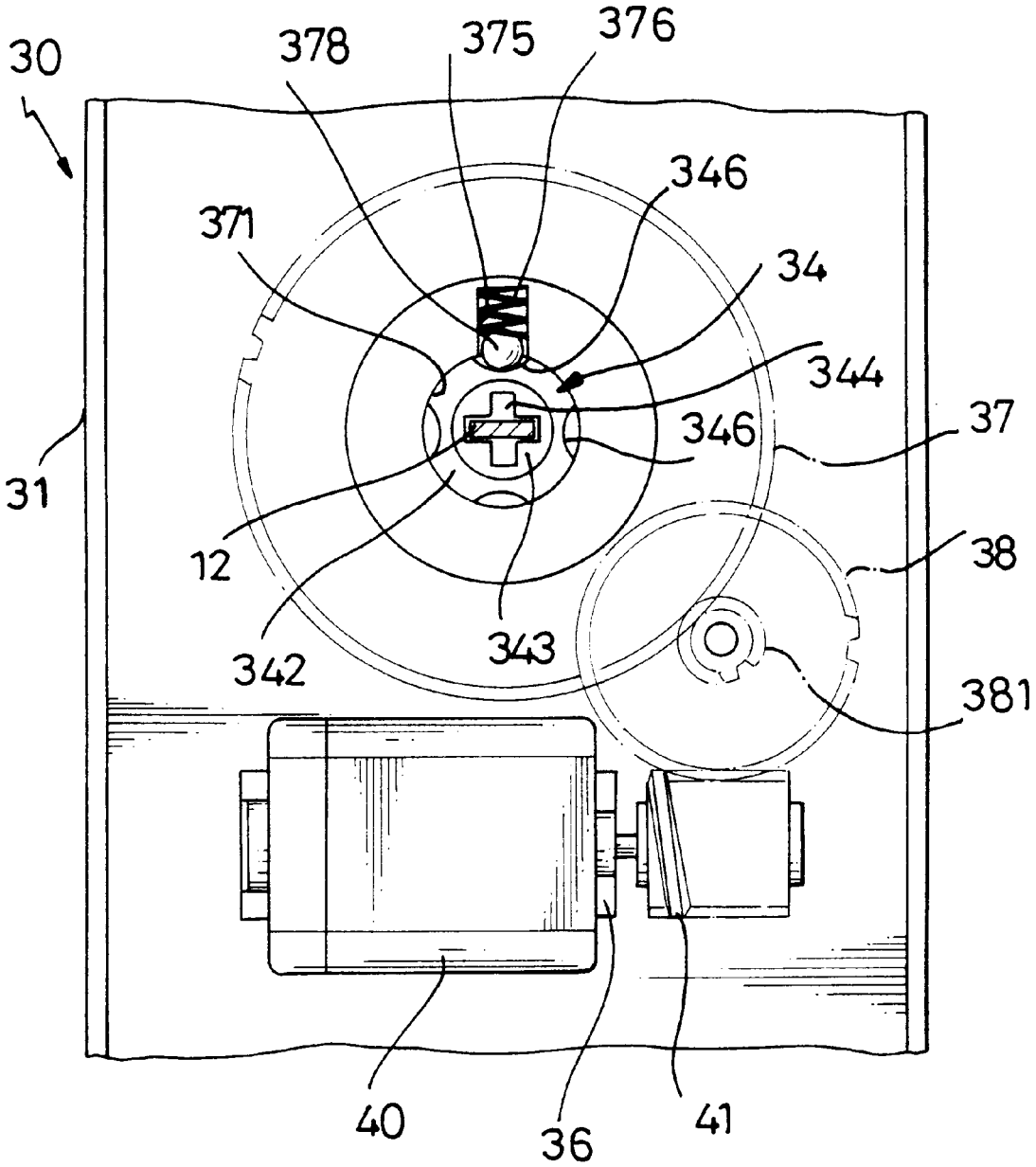
FIG. 7 is a side plan cross-sectional assembly view of the motorized lock assembly in accordance with a second embodiment of the present invention.

Referring now to FIG. 7 with reference to FIGS. 1 and 2, in accordance with a second embodiment of the present invention, the receiving recess (372), the locking openings (373), the drive strips (374), and the rectangular block (341) are not included. The retaining cylinder (342) of the transmission mechanism (34) contains a plurality of arcuate dimples (346) in the periphery thereof, and the center hole (371) of the driven gear (37) contains a chamber (375) therein, a biasing member (376) received in the chamber (375), and a ball (378) pressed by the biasing member (376) to be partially received in one of the dimples (346).

In operation, the worm gear (41) can be rotated by the motor (40) to rotate the gear (38) which rotates the drive gear (381) which in turn rotates the driven gear (37) which rotates the retaining cylinder (342) by means of the ball (378) so as to rotate the extension post (343) which in turn rotates the elongate rotor (12) such that the rotary core (22) can be rotated by the elongate rotor (12), thereby moving the dead bolt (25) of the lock bolt (20) to extend outward from the door (50).

It should be clear to those skilled in the art that further embodiments may be made without departing from the scope and spirit of the present invention.

What is claimed is:

1. A motorized lock assembly for a door which includes a door (50) having an inside and an outside, said motorized lock assembly comprising:

a lock bolt (20) fixedly mounted in said door (50) and including a rotary core (22) rotatably mounted therein, said rotary core (22) containing a first slot (220) therein;

an inside assembly (30) comprising:

a casing (31) attached to the inside of said door (50);

a transmission mechanism (34) including a rectangular block (341) rotatably mounted in said casing (31), a retaining cylinder (342) integrally extending from said rectangular block (341), and an extension post (343) integrally extending from said retaining cylinder (342) and containing a second slot (344) aligning with said first slot (220); and drive means for rotating said rectangular block (341), said drive means comprises a driven gear (37) mounted on said rectangular block (341) for rotating it, a gear (38) rotatably mounted in said casing (31), a drive gear (381) fixedly mounted on said gear (38) and meshing with said driven gear (37), a worm gear (41) rotatably mounted in said casing (31) and meshing with said gear (38), and a motor (40) mounted in said casing (31) for rotating said worm gear (41); and an outside assembly (10) attached to the outside of said door (50) and including an elongate rotor (12) rotatably mounted thereon and in turn extending through said first slot (220) and said second slot (344) such that said rotary core (22) rotates in conjunction with said extension post (343).

2. The motorized lock assembly in accordance with claim 1, wherein said driven gear (37) transversely contains a receiving recess (372) for receiving said rectangular block (341), and said drive means further comprises two elastic drive strips (374) each fixedly mounted in said receiving recess (372) and each pressing said rectangular block (341) such that said rectangular block (341) rotates in conjunction with said driven gear (37).

3. The motorized lock assembly in accordance with claim 2, wherein said receiving recess (372) contains two pairs of opposite locking openings (373) in the periphery thereof for receiving each of said two elastic drive strips (374) therein.

4. The motorized lock assembly in accordance with claim 2, wherein said driven gear (37) transversely contains a center hole (371) open to said receiving recess (372) for receiving said retaining cylinder (342) therein.

5. The motorized lock assembly in accordance with claim 1, wherein said inside assembly (30) further comprises a support shaft (35) fixedly mounted in said casing (31) and extending through said gear (38).

6. The motorized lock assembly in accordance with claim 1, wherein said inside assembly (30) further comprises two brackets (36) fixedly mounted in said casing (31) for retaining said motor (40) therebetween.

7. The motorized lock assembly in accordance with claim 1, wherein said inside assembly (30) further comprises a knob (311) rotatably mounted on said casing (31) and including a spindle (312) fixedly mounted in said rectangular block (341).

8. The motorized lock assembly according to claim 1, further comprising a first cam disk (60) fixedly mounted on said driven gear (37) to rotate therewith, two opposite arcuate lugs (62) each formed on the periphery of said first cam disk (60) and each including a locking tooth (621), and a second cam disk (66) mounted on said gear (38) for stopping said locking tooth (621) of one of said two arcuate lugs (62).

9. The motorized lock assembly in accordance with claim 8, wherein said first cam disk (60) contains two opposite concave openings (61) each between said two arcuate lugs (62).

10. The motorized lock assembly according to claim 8, further comprising a microswitch (64) mounted in said casing (31) and including a control lever (640) pivotally mounted thereon and abutting the periphery of said first cam disk (60).

* * * * *